US009464497B2

(12) United States Patent
Kekarainen

(10) Patent No.: US 9,464,497 B2
(45) Date of Patent: Oct. 11, 2016

(54) SEAL HOLDER AND METHOD FOR SEALING A BORE

(75) Inventor: Jarmo Kekarainen, Valbo (SE)

(73) Assignee: Aker Subsea AS, Lysaker (NO)

( * ) Notice: Subject to any disclaimer, the term of this patent is extended or adjusted under 35 U.S.C. 154(b) by 1047 days.

(21) Appl. No.: 13/519,497

(22) PCT Filed: Jan. 7, 2011

(86) PCT No.: PCT/NO2011/000006

§ 371 (c)(1),
(2), (4) Date: Jun. 27, 2012

(87) PCT Pub. No.: WO2011/084068

PCT Pub. Date: Jul. 14, 2011

(65) Prior Publication Data

US 2013/0069315 A1 Mar. 21, 2013
US 2013/0307219 A2 Nov. 21, 2013

(30) Foreign Application Priority Data

Jan. 7, 2010 (NO) ..... 20100012
Mar. 10, 2010 (NO) ..... 20100340

(51) Int. Cl.
*E21B 33/03* (2006.01)
*E21B 33/12* (2006.01)
(Continued)

(52) U.S. Cl.
CPC ..... *E21B 33/03* (2013.01); *E21B 33/035* (2013.01); *E21B 33/038* (2013.01); *E21B 33/1208* (2013.01)

(58) Field of Classification Search
CPC ..... F16J 3/03; F16J 15/164; E21B 33/03; E21B 33/035; E21B 33/038; E21B 33/12; E21B 33/1208; E21B 33/128; E21B 33/1285
USPC ..... 277/328, 609, 616, 630, 634, 637; 166/192
See application file for complete search history.

(56) References Cited

U.S. PATENT DOCUMENTS 1,801,006 A * 4/1931 Jacoby ..... 220/305
3,269,582 A 8/1966 Knocke
(Continued)

FOREIGN PATENT DOCUMENTS

EP 0687801 A2 12/1995
EP 1326002 A2 7/2003
(Continued)

OTHER PUBLICATIONS

Bäcknert, Christer, "International Search Report" for PCT/NO2011/000006, as mailed Apr. 19, 2011, 4 pages.
(Continued)

*Primary Examiner* — Vishal Patel
*Assistant Examiner* — Stacy Warren
(74) *Attorney, Agent, or Firm* — Winstead PC

(57) ABSTRACT

A seal holder for retaining a sealing arrangement (119,121), said sealing arrangement (119,121) being adapted to seal against a facing seal surface (209) in a bore (203), said seal holder having an intermediate section (117*a*) encircled by a peripheral section (117*b*) arranged for carrying said seal arrangement (119,121), wherein said intermediate section (117*a*) is convex shaped towards the pressure side and is adapted to exert radial pressure on said peripheral section (117*b*) in the event of exposure to pressure on its convex side. The invention also relates to a method for sealing a bore by applying an apparatus equipped at its lower end with a seal holder (117) retaining a sealing arrangement (119, 121).

10 Claims, 6 Drawing Sheets

(51) Int. Cl.
*E21B 33/035* (2006.01)
*E21B 33/038* (2006.01)

(56) References Cited

U.S. PATENT DOCUMENTS 3,831,680 A * 8/1974 Edwards et al. ..... 166/311
4,138,030 A * 2/1979 Andersson ..... F16J 13/06 220/327
4,651,818 A 3/1987 Johnson et al.
4,658,902 A * 4/1987 Wesson ..... E21B 34/063 166/317
5,685,372 A 11/1997 Gano
5,988,276 A * 11/1999 Oneal ..... E21B 23/01 166/118
5,992,526 A 11/1999 Cunningham et al.
6,793,019 B2 9/2004 Rodgers et al.
2003/0044227 A1* 3/2003 Parker ..... 403/135
2003/0127224 A1* 7/2003 Vick et al. ..... 166/285
2008/0210435 A1 9/2008 Goonetilleke et al.
2009/0025939 A1 1/2009 Wenham et al.
2009/0139720 A1* 6/2009 Frazier ..... 166/295
2009/0151958 A1 6/2009 Gramstad et al.
2012/0168173 A1* 7/2012 Urquhart et al. ..... 166/368

FOREIGN PATENT DOCUMENTS

GB 2312455 A 10/1997
GB 2456191 A 7/2009

OTHER PUBLICATIONS

Backnert, Christer, "International Search Report" for PCT/NO2011/000005 as mailed Apr. 19, 2011, 4 pages.

* cited by examiner

SEAL HOLDER AND METHOD FOR SEALING A BORE

FIELD OF THE INVENTION

The present invention relates to a specially designed seal holder that can be employed with any cap for removable sealing a bore of a tubular well assembly. Such a cap may be a tree cap, arranged on the spool of a Xmas tree. The present invention also relates to removable sealing a bore of a tubular well assembly and a method for sealing a bore.

TECHNICAL BACKGROUND

In the field of subsurface wells such as oil and gas wells, various methodologies are already known for sealing the bore of a tubular well assembly, such as that of a Xmas tree. For instance, for sub-sea wells it is known to arrange a tree cap on top of the Xmas tree spool. The tree cap comprises a stinger which is inserted into the bore of the Xmas tree. In some cases, the Xmas tree spool comprises a production bore and a smaller annulus bore. Furthermore, some Xmas trees are used for injection wells to inject fluid into the well bore. The tree cap may then comprise two stingers, of which one is inserted into each of these bores.

It is also known to seal off bores with other bore barrier arrangements, such as plugs, which are provided with locking means. European patent application EP 0687801 describes a wire line plug with a metal-to-metal sealing, arranged to be locked in a bore with internal locking grooves. The plug has locking keys (4) arranged to engage with the locking grooves of the bore. An axially movable expander sleeve (3) provides radial movement of the locking keys when it is moved axially. The expander sleeve and the locking keys are provided with sliding faces of different inclination, providing different radial moving distances with respect to the axial moving distance of the expander sleeve, in dependence on the engaged inclined face.

In order to lock the stinger or cap in place, it is known to arrange radially movable dogs, which can engage with inner locking profiles in a bore. To move the dogs radially, it is known to slide a locking sleeve along their inner faces. The locking sleeve typically has an inclined face which moves the dogs radially outward when the sleeve is moved down. In order to move such a locking sleeve down, however, it is common to use a tool which, before moving the sleeve, has to be secured to the well arrangement. This is to prevent the tool from moving upward when forcing the locking sleeve down.

The movement of a locking sleeve is typically provided for by hydraulic pistons in the running tool or by providing linear movement with an ROV actuation device.

In the known technologies relating to sealing of bores, seal holder is generally provided for retaining sealing means to effectively seal the bore. Of course, effective sealing is achieved by such sealing means, in combination with the other components, some of which are as described hereinabove.

In prior art, common in the field of sealing bores, seal holders are known to carry sealing elements to form the final seal. However, the focus in such prior art has been found to be not on the seal carrier which merely functions in a normal and known way to form a seal, by virtue of the sealing elements it carries. Rather, the focus has always been on the constructional features of the combination of different components, to form an effective capping. For example, GB 2456191 A discloses a subsea well production tree having an annular cavity, a communication gallery and a tree cap. The annular cavity is located at the upper end surrounding the upper ends of the production bore and annulus bore. The communication gallery is located between the annulus bore and annular cavity. The tree cap has a production bore mandrel and an annular sealing member. The production bore mandrel extends from the upper portion of the tree cap down to the production bore. The sealing member extends from the upper portion of the tree cap down to the annular cavity. The method of sealing comprises landing the tree cap on the tree, inserting the production bore mandrel into the production bore and inserting the sealing member into the annular cavity to form a seal between the communication gallery and annular cavity.

In GB 2456191A again, the focus of the invention is not on any special configuration of any seal carrier/holder. Rather, focus is on a combination of several components such as annular cavity, communication gallery, production mandrel and a sealing member. It is mainly this combination which causes effective sealing and there is no teaching regarding any seal holder/carrier having inherent adaptations for enhancing the sealing action.

From U.S. Pat. No. 5,992,526A it is known a seal holder for use in a tree cap. The seal holder comprises two stab members sealing the bores. The stab members having sealing elements which seal against the bores.

US2009/0151958 A1 describes a temporary sealing element for use in a well, comprising a crushable sealing element which is convex shaped against the pressure side.

Also U.S. Pat. No. 5,685,372 describes a crushable plug for use in a well where the plug has a convex form.

Hence, in existing prior art no teaching exists regarding a seal holder per se, which by virtue of its adaptations, enhances the sealing action of a bore of a tubular well assembly. Accordingly there was a need to design a seal holder, which by virtue of its construction, effectively enhances the sealing of a bore of a tubular well element.

OBJECTS OF THE INVENTION

The present invention aims to meet the above need hitherto not taught by prior art, by providing a specially constructed seal holder, which by virtue of its specially configured construction, plays a significant role in forming an effective removable seal on a bore of a tubular well assembly.

Another object of the present invention is to provide a method of sealing a bore of a tubular well assembly, by applying the seal holder of the present invention, in virtue of its specially configured construction.

In addition, the present invention discloses some advantageous features still not disclosed in prior art.

All through out the specification including the claims, the words "rotating actuator", "locking means", "actuating sleeve", "seal holder", "sealing arrangement", are to be interpreted in the broadest sense of the respective terms and includes all similar items in the field known by other terms, as may be clear to persons skilled in the art. For example, a seal holder may be known as a seal carrier. Restriction/limitation, if any, referred to in the specification, is solely by way of example and understanding the present invention.

SUMMARY OF THE INVENTION

According to a first aspect of the present invention there is provided a seal holder for retaining a sealing arrangement, said sealing arrangement being adapted to seal against a facing seal surface in a bore. The seal holder has an intermediate section encircled by a peripheral section arranged for carrying said seal arrangement. According to the invention, the intermediate section is convex shaped towards the pressure side and is adapted to exert radial pressure on said peripheral section in the event of exposure to pressure on its convex side.

According to an advantageous embodiment of the first aspect of the present invention the intermediate section is adapted to bend to exert radial pressure on said peripheral section in the event of exposure to pressure on its convex side.

Thus, the adaptation in the seal holder, namely the curvature in its intermediate section in the form of a convex part facing the pressure side, together with the peripheral section of the seal holder, carrying the sealing arrangement, enhances the sealing action of the bore. This advantageous adaptation is hitherto not known or conceived in the field of sealing of bores of a tubular well element such as that of a Xmas tree.

According to another advantageous embodiment of the first aspect of the present invention said peripheral section is adapted to be forced along said seal surface on said bore in the event of exertion of radial pressure on said peripheral section.

According to another advantageous embodiment of the first aspect of the present invention said sealing arrangement is adapted to enter the sealing region of said surface on said bore, in the event of said peripheral section being forced against said surface on said bore, to seal said bore along such seal surface.

According to yet another advantageous embodiment of the first aspect of the present invention the diameter of said bore is smaller in the region of said seal surface than above said seal surface.

According to another advantageous embodiment of the first aspect of the present invention said sealing arrangement comprises a pair each of a first sealing element and a second sealing element.

Preferably the first sealing element is a metal-to-metal seal arrangement and said second sealing element is a polymer seal arrangement.

According to a further advantageous embodiment of the first aspect of the present invention the seal holder is adapted to be applied for sealing a production bore and/or an annulus bore or any bore of a tubular well assembly such as that of a Xmas tree.

According to a second aspect of the present invention there is provided a method for sealing a bore by applying an apparatus equipped at its lower end with a seal holder retaining a sealing arrangement comprising, landing said apparatus suitably on the tubular well assembly of said bore, said method is characterized by:

thereafter, gradually moving down said seal holder by a suitable means along said bore such that an intermediate section of said seal holder, being curved with its convex side facing the pressure exposure side in said bore, exerts radial pressure on the peripheral section of said seal holder causing sealing of said bore along a surface on said bore.

According to an advantageous embodiment of the second aspect of the present invention the convex side of said seal holder gets slightly bent on exposure to pressure, forcing said peripheral section along a surface on said bore and consequently, said sealing arrangement being arranged in connection to said peripheral section, enters the sealing region of said surface, causing sealing of said bore along such sealing surface.

Preferably the seal holder is gradually moved down along said bore by axial movement of an actuation sleeve, said actuation sleeve being operatively connected at its lower end to said seal holder, said axial movement also actuating radial movement of a locking means for retaining said apparatus in position on the landing shoulder of said tubular well assembly, during said sealing.

More preferably, the axial movement of said actuation sleeve is effected by a rotating actuator.

SHORT DESCRIPTION OF THE FIGURES

Having described the main features of the invention above, a more detailed and non-limiting description of an exemplary embodiment will be given in the following with reference to the drawings, in which FIG. 1 is a partial cross section view of a seal holder according to the present invention FIG. 2 is a cross section view of a tree cap arranged in the inner bore of a sub sea Xmas tree having the seal holder according to the present invention applied thereon;

In the above context it is hereby clarified that simply by way of example and for understanding the present invention and not by way of any limitation, the seal holder in accordance with the present invention, has been referred to as being applicable on the production bore of a Xmas tree. It should be understood to persons skilled in the art that, the seal holder in accordance with the present invention is equally applicable to all other bores such as those in offshore/subsea and onshore areas and will be equally effective, in achieving the objects of the present invention. Further, the seal holder is equally applicable to seal all types of production bores as well as annulus bores of a tubular well assembly, in the same manner as described under the heading detailed description of the invention.

DETAILED DESCRIPTION OF THE INVENTION

Figure 1:
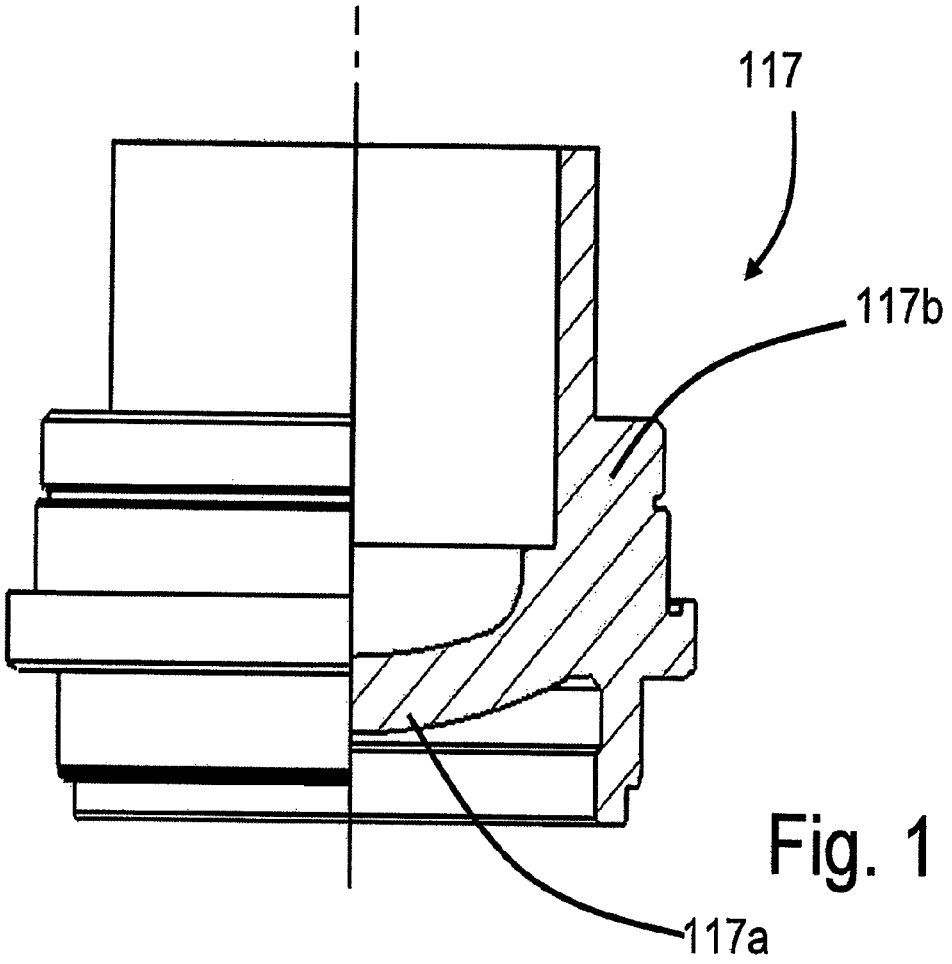

The accompanying FIG. 1 illustrates a cross-sectional view of the seal holder according to the present invention. The seal holder 117 is located at the lower part of the tree cap 100 as shown in the accompanying FIGS. 2, 3 and 4. As illustrated in FIG. 1, the seal holder 117 comprises an intermediate section 117*a* which is encircled by a peripheral part 117*b*. The seal arrangement comprises a plurality of seals and is arranged in connection to the peripheral part 117*b*. The intermediate section 117*a* of the seal holder 117 is curved with a convex part facing the pressure side of the seal holder 117. Thus, when exposed to a pressure in the XT bore 203 (illustrated in the accompanying FIGS. 2, 3 and 4) as described later with reference to the FIGS. 2 to 4, the intermediate section 117*a* will be slightly bent. This bending causes the peripheral part 117*b* to be forced against the surface of the XT bore 203, thereby enhancing the sealing action of the seal arrangements 119, 121. Thus, the seal holder 117 plays a significant role in enhancing the sealing action by virtue of the curved part of the intermediate section, in combination with the peripheral section 117*a* retaining the sealing arrangement 119, 121. Preferably, the sealing arrangement comprises a pair each of a first sealing element 121 and at least a second sealing element 119. However, it will be understood by persons skilled in the art that there may be a plurality of seals in the sealing arrangement, retained by the outer walls of the peripheral section of the seal holder. The seal holder may be made of homogeneous inconel and other types of steel.

How the seal holder 117 functions in combination with the other components of the cap to enhance the sealing action of the bore by virtue of its novel construction, will be clear from the FIGS. 2 to 6. Various features of the cap have been described in FIGS. 2 to 6 to emphasize how the seal holder in accordance with the present invention, works in connectivity with the other components of the cap. However, it should be understood to persons skilled in the art that the seal holder according to the present invention is not restricted in its use with any specific type of cap/apparatus/tree for sealing a bore.

As it will be clear from the following description, that after the cap is landed suitably on the landing shoulder 205 of the tree, preferably the rotating actuator 111 rotates the actuation sleeve 109 axially to actuate the locking means 101 in a radial direction. The seal holder 117 is located at one end of the actuation sleeve 109, which is a distal end in the bore further than the locking means 101. The locking means 101 maintain the cap in position during the sealing action.

Figure 2:
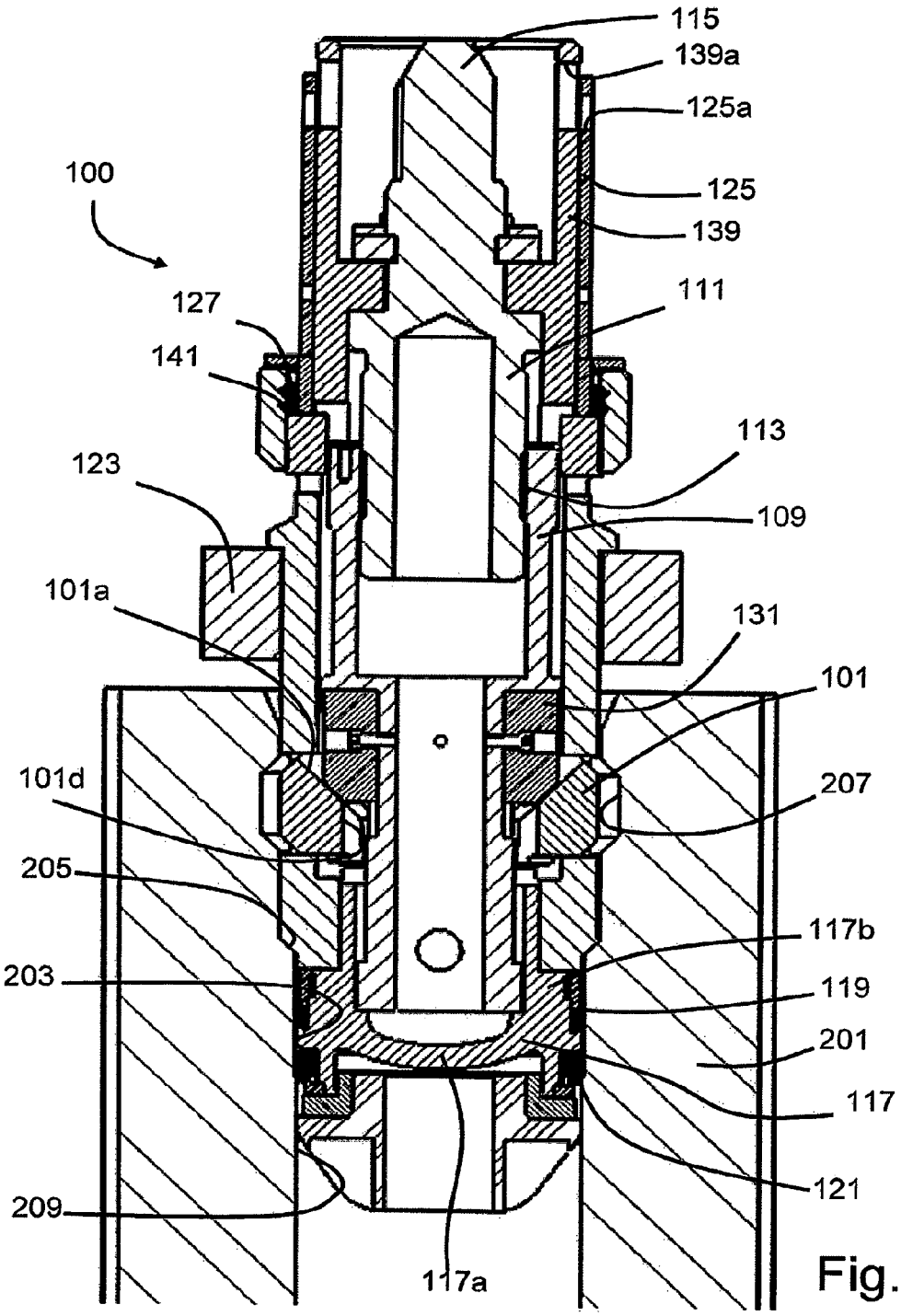

FIG. 2 shows a cross section of a tree cap 100 having applied thereon, the seal holder 117 according to the present invention. The tree cap 100 is landed in the bore 203 of the tree spool 201 of a sub sea Xmas tree. The tree cap 100 rests on a landing shoulder 205 inside the Xmas tree bore 203.

The tree cap 100 has a plurality of locking dogs 101 which are radially movable into a facing internal locking groove 207 of the tree spool 201. The radial movement of the dogs 101 is provided with a downward movement of an actuation sleeve 109. Furthermore, the actuation sleeve 109 is in a threaded engagement with a rotating actuator 111. That is, a threaded interface 113 between the actuation sleeve 109 and the rotating actuator 111 comprises mutually engaging threads. When the rotating actuator 111 is rotated, the actuation sleeve 109 will move in an axial direction, upwards or downwards depending upon the direction of rotation. In its upper part, the rotating actuator 111 exhibits a rotation interface 115 adapted for interface with, for instance, a torque tool or an ROV rotation tool (not shown).

To prevent rotation of the tree cap 100 due to rotation of the rotating actuator 111, a pin and hole arrangement (not shown) can preferably be arranged at the top of the tree spool 201. A pin extending from the tree cap 100 into the hole in the tree spool 201 will prevent rotation of the tree cap 100.

Rather than a threaded interface 113, other means may be arranged for converting the rotational movement of the rotating actuator 111 to the axial movement of the actuation sleeve 109. Such means can for instance be a roller screw assembly.

At the lower end of the actuation sleeve 109, is arranged the seal holder 117 according to the present invention. The seal holder may be connected to the actuating sleeve by means of threads or by means of a transverse extending locking pin. Arranged to the seal holder 117 and as shown in the accompanying FIG. 1, are at least a polymer seal arrangement 119 and at least a metal-to-metal seal arrangement 121. Below the position of the seal arrangement 119, 121 shown in the accompanying FIG. 2, the XT bore 203 exhibits a narrowed portion which constitutes a bore seal surface 209. As it will be further clear from the description of the FIGS. 3 to 5 below, the seal arrangement 119, 121 is moved into the area of the seal surface 209 when the activation sleeve 109 is moved downwards. It is not readily seen from the accompanying FIG. 2, but the bore diameter of the inner bore 203 of the Xmas tree spool 201 is slightly smaller at the seal surface 209 than at the position of the seal arrangement 119, 121 shown in the FIG. 2, above said seal surface. Thus, the seal arrangement 119, 121 is actuated, i.e. put into sealing condition, when it enters the region of the seal surface 209.

The tree cap 100 also comprises a retainer plate 123, an emergency release sleeve 125 and emergency release split ring 127.

Figure 3:
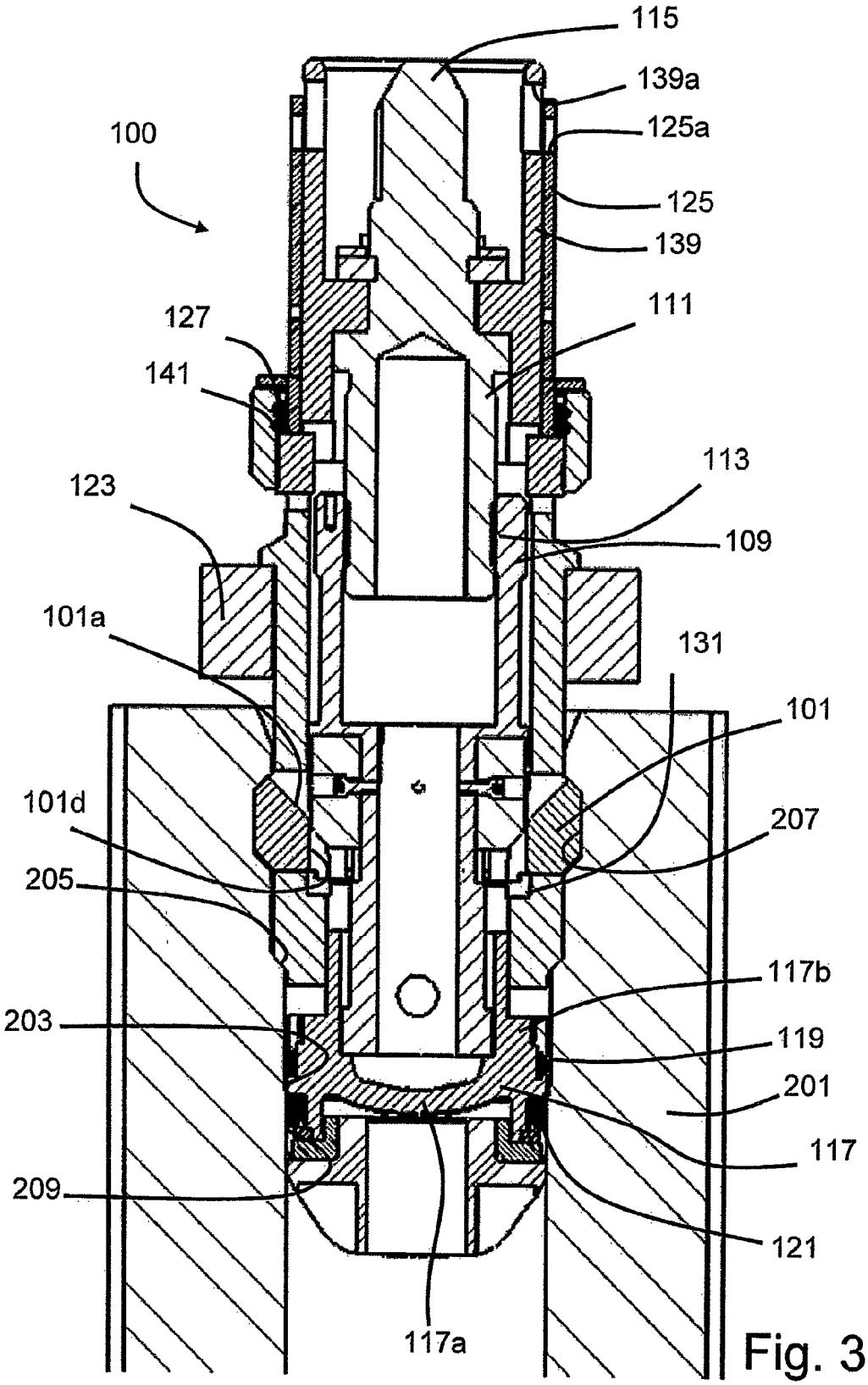
FIG. 3 is a cross section view of the tree cap in FIG. 2, locked to the Xmas tree having the seal holder according to the present invention applied thereon.

The accompanying FIG. 3 is a cross section view corresponding to FIG. 2. It shows a position during the process of capping the XT-bore, where the actuation sleeve 109 has been moved a first distance axially downwards. This figure further elaborates how the seal holder according to the present invention, enhances the sealing action of the bore. The movement of the actuation sleeve 109 has been provided by means of a torque tool (not shown) for rotating the rotating actuator 111 by engagement with the rotation interface 115. Instead of a torque tool, another rotation providing means could be used, preferably a means of an ROV. The locking dogs 101 have now been moved into the facing internal locking profile 207 of the tree spool 201. Furthermore, the metal-to-metal seal arrangement 121 has entered the area of the seal surface 209 of the Xmas tree bore 203. As will be described in greater detail further below, the locking dogs 101 have now been moved by sliding engagement with a plurality of cams 131 arranged on the actuation sleeve 109. The cams 131 have slid against large inclination faces 101*a* of the locking dogs 101. The large inclination faces 101*a* have an inclination of 45 degrees with respect to the axial and radial direction. This ensures a relatively large radial movement of the locking dogs 101 per axial movement of the actuation sleeve 109. Below the large inclination face 101*a* is a vertical face 101*d*.

Figure 4:
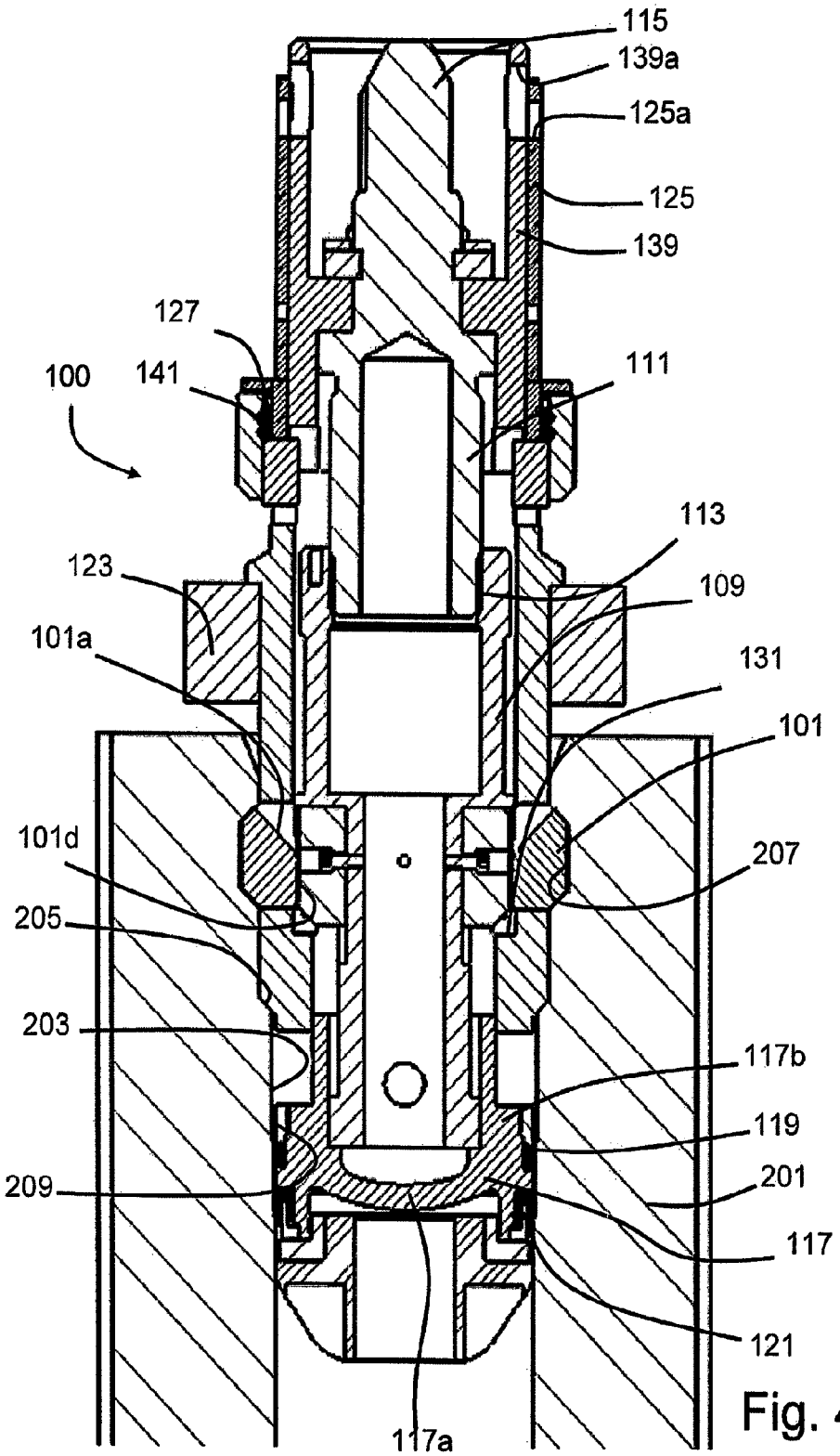
FIG. 4 is a cross section view of the tree cap in FIG. 2 and FIG. 3, locked to the Xmas tree and showing the two seal arrangements retained by the seal holder according to the present invention in a sealing position.
Figure 5:
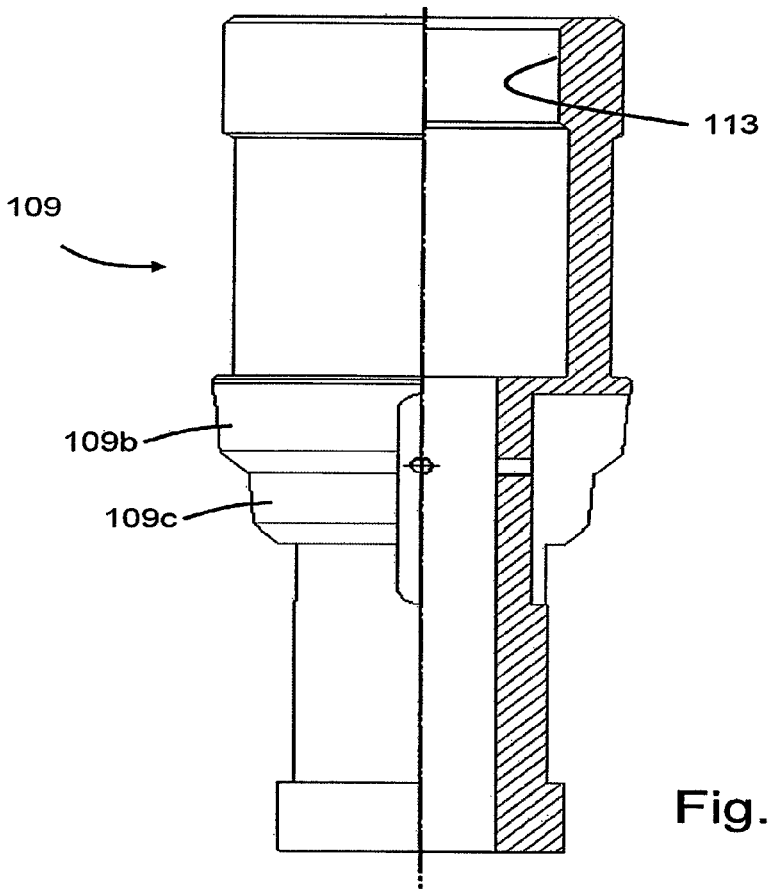
FIG. 5 is a partial cross section view of an actuation sleeve.

In the accompanying FIG. 4, the actuation sleeve 109 has been moved down to its lowermost position. Seal arrangements, that is the polymer seal arrangement 119 and the metal-to-metal seal arrangement 121, have now been moved into the area of the seal surface 209 and are thus in a sealing position. Furthermore, the locking dogs 101 have been moved a further small radial distance into the internal locking profile 207.

A person skilled in the art will appreciate that the locking dogs 101 will be suitable also in connection with other ways of activation, such as hydraulic actuation of an actuation sleeve.

The radial movement of the locking dogs 101 and the axial movement of the actuation sleeve 109 respectively, comprise three phases. This is now explained below, with greater elaboration with reference to FIGS. 3 to 5, particularly to understand how these movements facilitate the seal holder in accordance with the present invention, to enhance the sealing of the bore by virtue of its novel construction.

A first phase comprises the large distance radial movement of the locking dogs 101 by means of the large inclination faces 101*a*. This is illustrated in the accompanying FIG. 3. In this first phase, there is little force needed to move the locking dogs 101 radially. This first phase locks the tree cap 100 to the tree spool 201. This enables the second phase to take place. In the second phase illustrated in the accompanying FIG. 4 the actuation sleeve 109 reaches its lower most position and the seal arrangements 119, 121 are forced into the region of the seal surface 209 of the bore 203. This is where the seal holder 117, in accordance with the present invention contributes. The intermediate section 117*a* of the seal holder 117, being curved with a convex part facing the pressure side of the seal holder 117, on exposure to the pressure in the XT bore 203 slightly bents. This, bending causes the peripheral part 117*b* to be forced against the surface of the XT bore 203, thereby enhancing the sealing action of the seal arrangements 119, 121 which are carried by the peripheral section 117*b*. This is how the seal holder 117 plays a significant role in enhancing the sealing action of the sealing arrangement 119,121 by virtue of the curved part of the intermediate section, in combination with the peripheral section 117*a* retaining the sealing arrangement 119, 121. The region of the seal surface 209 has a smaller diameter than what the bore 203 above the seal surface 209 has. In order to be able to force the sealing arrangements into this region, the locking dogs 101 maintain the tree cap 100 in its place despite the vertical forces between the seal arrangements 119, 121 and the tree spool 201 during this second phase. On forcing of the peripheral section 117*b* against the surface on the bore 203, the sealing arrangement gets inserted into the region of the seal surface 209.

In the succeeding third phase, the actuation sleeve 109 is moved further down. During this movement, the upper and lower inclined actuation sleeve faces 109*b*, 109*c* as illustrated in the FIG. 5 engages with the upper and lower small inclination faces of the locking dogs (not shown). The locking dogs 101 are then only moved a small distance into the locking profile 207, however with a much larger force, as they already may be in contact with the faces of the locking profile 207. This larger force is provided with the much smaller inclination of the upper and lower small inclination faces (not shown).

It should be noted that in the place of an upper and lower small inclination face, one could also use only one small inclination face. An advantageous inclination angle could be 4 degrees with respect to the axial direction, but also more or even less.

One could also imagine the second and third phases, as described above, to take place simultaneously. That is, moving the locking dogs 101 the last force-requiring distance and forcing the seal arrangements 119, 121 into the seal surface 209 region at the same time.

As stated before, the seal holder according to the present invention is equally applicable to seal production bores as well as annulus bores in the same manner as described under the heading Detailed description of the invention and is not restricted in its use with any specific type of cap/apparatus/tree.

With the term convex is herein meant a shape which protrudes towards the pressure side of the seal holder, and which as a result of this exerts a radial force onto the peripheral part when exposed to pressure from the pressure side. Thus, for instance an intermediate part with a V-shaped cross section will fall within the term convex as used herein The accompanying FIG. 6 illustrates how the seal holder according to the present invention seals an annulus bore as well as a production bore of a Xmas tree.

The tree cap 100 according to this embodiment comprises two stingers for entering into two separate bores in a Xmas tree. FIG. 6 shows a cross section view of a tree cap 100 adapted for entering a production bore, such as bore 203 in the FIG. 2 and an annulus bore (not shown). Thus, the tree cap 100 shown in FIG. 6 has a production bore stinger 102 and an annulus bore stinger 104. Preferably, the annulus bore stinger 104 is entered into the annulus bore by rotational movement of a second rotating actuator 133 which engages with the stinger itself through a threaded interface 135. Thus, by rotating the second rotating actuator 133, the annulus stinger 104 is inserted into the (not shown) annulus bore of the Xmas tree. This should be performed after the production bore stinger 102 has been locked in the bore 203, i.e. the production bore. The annulus stinger 104 does not need to be locked in the annulus bore, since the tree cap 100 itself is locked onto the Xmas tree by means of the locking dogs 101 described above. The retainer plate 123 maintains the two stingers as one tree cap construction. The annulus stinger 104 exhibits a seal arrangement 137 for sealing in the annulus bore. Preferably and not by way of any limitation this seal arrangement 137 is adapted to be identically configured with a seal holder according to the present invention (not shown) very much like the seal arrangement 119,121 and functions with identical effectiveness.

Figure 6:
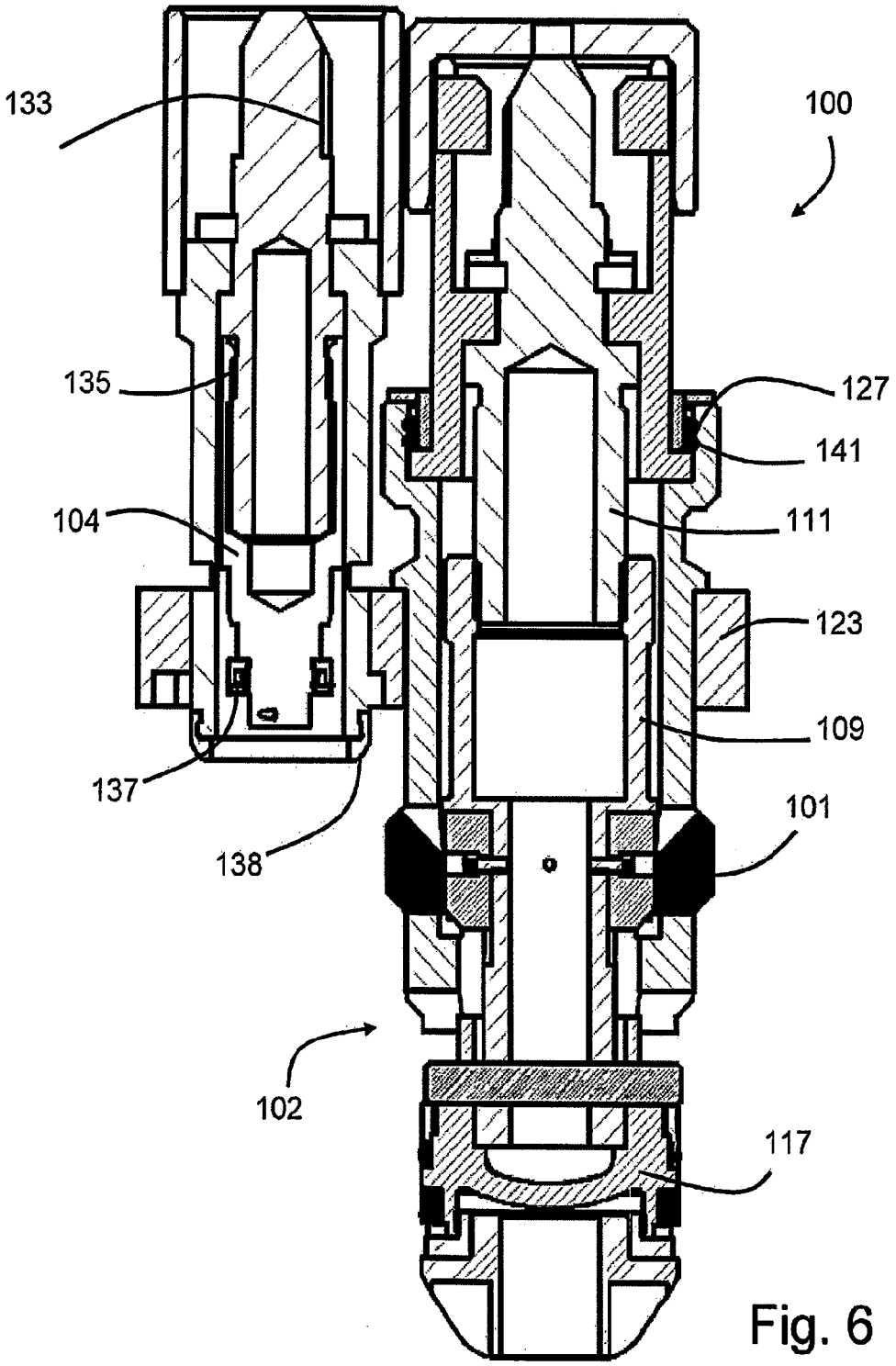
FIG. 6 is a cross section view of a tree cap adapted for application of the seal holder according to the present invention on a Xmas tree with a production bore and an annulus bore.

The tree cap 100 shown in FIG. 6 has an annulus stinger orientation nose 138 which is arranged to extend slightly into the upper part of the annulus bore, thereby aligning the annulus stinger 104 with the axial centre of the annulus bore (not shown). At the same time, the annulus stinger orientation nose 138 will function as an anti rotation means for the tree cap 100.

One could also imagine the arrangement of the locking dogs 101, actuation sleeve 109 and cams 131, as described herein, with another means for moving the actuation sleeve in the locking direction. Such means can for instance comprise a hydraulic actuator, as is common in the art and known to a person skilled in the art.

It should be amply clear to persons skilled in the art, that the cap 100 having the seal holder 117 in accordance with the present invention, can be released to remove the seal from the concerned bore by rotation of the rotating actuator 111 in the other direction. This causes axial and upward movement of the actuation sleeve 109 having the seal holder 117. Consequently, the locking dogs 101 are initiated to move radially inwards to gradually release the cap 100. The possible annulus stinger 104 if any, as described with reference to the FIG. 6, will also be pulled out by this action since it is not locked in the annulus bore.

If the rotating actuator 111 fails then the entire releasing operation as described in the preceding paragraph, may be effected by installing an emergency releasing tool on the cap and simply pulling it upwards.

A person skilled in the art will appreciate that the advantages of the seal holder 117 will exist also with other arrangements where a bore shall be sealed. The present invention has been described with reference to an exemplary embodiment and some drawings for the sake of understanding only and it should be clear to persons skilled in the art, that the present invention includes all legitimate modifications within the ambit of what has been described hereinbefore and claimed in the appended claims.

The invention claimed is:

1. A seal holder for retaining a sealing arrangement, said sealing arrangement being adapted to seal against a facing seal surface in a bore, wherein a pressure side is on one axial side of the sealing arrangement, said seal holder comprising:

an intermediate section encircled by a peripheral section arranged for carrying said sealing arrangement, the intermediate section having an axial extension within the peripheral section, the axial extension entirely closing an area within the peripheral section the intermediate section and the peripheral section being monolithic;

wherein said intermediate section exerts a radial sealing force on said peripheral section in an event of exposure to pressure on the pressure side of the intermediate section, as the pressure side of the intermediate section is convex shaped towards the pressure side and bends when exposed to said pressure;

wherein the intermediate section is arranged radially within the peripheral section and at the same axial position as the peripheral section;

wherein the peripheral section is part of an axially extending cylindrical hollow body; and wherein the axially extending cylindrical hollow body extends axially beyond the axial extension of the intermediate section at both axial sides of the axial extension.

2. The seal holder according to claim 1, wherein said peripheral section is adapted to be forced against said seal surface on said bore in an event of exertion of radial pressure on said peripheral section.

3. The seal holder according to claim 2, wherein said sealing arrangement is adapted to enter a sealing region of said seal surface on said bore, in an event of said peripheral section being forced against said seal surface on said bore, to seal said bore along said seal surface.

4. The seal holder according to claim 2, wherein a diameter of said bore is smaller in a region of said seal surface than above said seal surface.

5. The seal holder according to claim 1, wherein said sealing arrangement comprises a pair each of a first sealing element and a second sealing element.

6. The seal holder according to claim 5, wherein said first sealing element is a metal-to-metal seal arrangement and said second sealing element is a polymer seal arrangement.

7. The seal holder according to claim 1, wherein said seal holder is adapted to be applied for sealing any bore of a tubular well assembly.

8. The seal holder according to claim 7, wherein the tubular well assembly is a Xmas tree.

9. The seal holder according to claim 7, wherein the bore is at least one of a production bore and an annulus bore.

10. The seal holder according to claim 1, wherein the pressure side of the intermediate section faces in an axial direction.

* * * * *